United States Patent [19]

Dominico et al.

[11] Patent Number: 4,671,093

[45] Date of Patent: Jun. 9, 1987

[54] TRANSFER ASSEMBLY FOR TUBE PRINTING APPARATUS

[75] Inventors: James Dominico, West Paterson; Joseph L. Mrak, North Haledon, both of N.J.

[73] Assignee: Van Dam Machine Corporation, Paterson, N.J.

[21] Appl. No.: 775,889

[22] Filed: Sep. 13, 1985

[51] Int. Cl.[4] ..... B21D 51/26

[52] U.S. Cl. ..... 72/133; 72/94; 101/38 A; 413/47

[58] Field of Search ..... 101/38 R, 38 A, 39, 101/40; 413/45, 47, 48, 49, 50, 51; 72/94, 133, 424; 118/44, 75, DIG. 11

[56] References Cited

U.S. PATENT DOCUMENTS 1,370,807 3/1921 Gray ..... 413/47

3,618,549 11/1971 Kaminski ..... 72/94

*Primary Examiner*—Lowell A. Larson

*Attorney, Agent, or Firm*—David A. Jackson

[57] ABSTRACT

A tube transfer assembly for a tube printer includes a rotatable mandrel wheel which successively moves the tubes to be printed to different stations of the tube printer; a plurality of mandrels mounted along the circumferential periphery of the mandrel wheel for holding the tubes thereon; a rotatable star wheel assembly including a plurality of pockets for successively supplying the tubes to a position at the free end of the mandrel at the 11:00 position of the mandrel wheel; a guide disc rotatable with the star wheel and having a plurality of circular apertures positioned about the periphery thereof in alignment with the pockets; a first pusher rod which successively pushes one end of each tube within one of the apertures at a first rotatable position of the star wheel to correctly configure such end of the tube in a circular configuration; a second pusher rod simultaneously moveable with the first pusher rod which successively pushes each tube onto the mandrel at the subsequent 11:00 position of the mandrel wheel; a plurality of sleeves slidably mounted on the mandrels; a backstop normally engaged with the sleeves at all but the 3:00 position of the mandrel wheel to prevent sliding movement of the sleeves on the respective mandrels and disengaged from the sleeve then positioned at the 3:00 position on the mandrel to permit sliding movement thereof; and a tube discharge assembly including a pusher take-off engaged with the sleeve at the 3:00 position of the mandrel wheel to slidably move the sleeve on the respective mandrel thereat so as to remove the tube on the mandrel.

18 Claims, 13 Drawing Figures

282
276
278
280
266
274
60
262
264
260
258
266
270
262
60
52
272
282
280
113
286
290
113
268
266
274
13
13
270
60
278
280
282
113
286
284
290
288

TRANSFER ASSEMBLY FOR TUBE PRINTING APPARATUS

BACKGROUND OF THE INVENTION

This invention relates generally to apparatus for applying print to the exterior surfaces of flexible tubes and, more particularly, is directed to mechanisms for transfering such tubes onto and off of a mandrel assembly of such apparatus.

In general, a variety of machines for applying a decorative print to containers, such as tubes and the like, are known. Such machines generally include an infeed or conveyor assembly that transports the tubes to a positioning unit that receives the tubes and moves them into position for transfer to corresponding mandrels located on a rotatable mandrel wheel. After the tubes are received on the corresponding mandrels, the mandrels are rotated into position for the printing operation, whereby a printing blanket is brought into contact with each of the tubes, to place a decorative finish on the outer cylindrical surfaces thereof. Thereafter, the mandrels bearing the tubes are moved to another location where the tubes are dried and then to still another location where a coat of varnish is applied to the decorated outer surface of each tube to finish the decoration thereon. The tubes are then removed onto a pin chain and the varnish is cured at a subsequent station, for example, by ultraviolet light.

As an example, U.S. Pat. No. 3,097,593 discloses apparatus for printing tubular sleeves. With this patent, after the flexible, plastic tube is dropped into a hopper, a first pusher member pushes the tube partially onto a mandrel. At the next rotational position of the mandrel wheel, a locating member having a ring engages the end of the tube to push the tube further onto the mandrel into a precise location thereon. The pushing operations are connected with and timed with the indexing mechanism for the mandrel wheel.

U.S. Pat. No. 3,250,213 discloses another tube decorating machine. With this patent, the tubes are transferred by a conveyor belt to respective of pockets or slots of a cylindrical shaped body portion which is rotated such that a first pusher pushes the tubes partially onto the mandrels and then at a second intermittent position, a second pusher completely pushes the tubes onto the mandrels.

U.S. Pat. Nos. 2,175,560; 2,288,617; 2,796,164; and 2,800,872 each disclose a single pusher rod for pushing the tubes onto the mandrels.

However, because the tubes are generally made of a plastic material, and are therefore flexible, the tubes tend to distort or get out of round, particularly during handling thereof. For example, U.S. Pat. No. 3,097,593, discussed above, includes two fingers which pick up the leading tube, and then drop such tube into the entrance hopper. However, the fingers tend to greatly distort the shape of the tube, as shown in FIG. 8 of the patent. As a result, the tube may exhibit an out-of-round configuration. This, in turn, may give rise to difficulties when the first pusher member attempts to partially push the tube onto a mandrel. U.S. Pat. No. 3,250,213, discussed above, in fact, specifically refers to the elliptical shape that the tubes often assume, at Column 4, Lines 43–46 thereof. Accordingly, with this patent, to ensure proper seating of the tubes on the mandrels, the ends of the mandrels must be modified. This, of course, results in greater complexity of the machine, since each mandrel must be modified and, in any event, is not a completely satisfactory solution.

With respect to the transfer of the tubes off of the mandrels, U.S. Pat. No. 3,097,593 includes a yieldably mounted star wheel having pockets and which closely engages around a portion of the outer periphery of each mandrel behind the container body thereon, as each mandrel is rotated to a predetermined position. The star wheel is connected through a linkage mechanism to a cam which rotates in time with the other moving parts of the machine. The cam causes a slide bar of the linkage mechanism, and thereby the star wheel connected thereto, to reciprocate at the proper time to strip the printed body entirely off the mandrel to a suitable point of discharge, such as a pin conveyor chain.

In a similar context, U.S. Pat. No. 4,089,294, for use with aluminum tubes that may not be dried, provides a two legged hanger for removing the tubes from a tube holder. U.S. Pat. No. 1,910,713 discloses a slide having a hook end which engages the rear edge of the tube and pulls it off the respective pin. See also U.S. Pat. No. 2,835,371 (FIGS. 9–12). Lastly, U.S. Pat. No. 1,892,545 teaches a stripper plate surrounding each conveyor pin for removing the sleeves from the pins, although the pins are arranged in the vertical direction.

The above exit transfer assemblies are not completely satisfactory, because of the complexity thereof and the problems with timing.

OBJECTS AND SUMMARY OF THE INVENTION

Accordingly, it is an object of the present invention to provide a transfer assembly for a tube printer in which the tubes are correctly configured prior to being pushed on the respective mandrels.

It is another object of the present invention to provide a transfer assembly for a tube printer in which a first pusher rod pushes one end of each tube through a respective circular aperture of a rotatable guide disc to correctly configure the respective end of the tube, prior to the tube being pushed onto its respective mandrel.

It is still another object of the present invention to provide a transfer assembly for a tube printer in which the tubes are stripped from the respective mandrels at a predetermined rotational position of the mandrel wheel.

It is yet another object of the present invention to provide a transfer assembly for a tube printer in which each mandrel is provided with a sleeve slidably mounted thereon for stripping the tubes from the mandrels, and a backstop normally engages the sleeves to prevent sliding movement thereof except at a predetermined rotational position of the mandrel wheel at which position the respective sleeve thereof strips the tube from the mandrel.

It is a further object of the present invention to provide a transfer assembly for a tube printer which is relatively easy and economical to manufacture and use.

In accordance with a first aspect of the present invention, a tube transfer assembly for a tube printer includes rotatable mandrel wheel means for successively moving tubes to be printed to different stations of the tube printer; a plurality of mandrel means for holding the tubes on the mandrel wheel means, each mandrel means having a free end; rotatable star wheel means including a plurality of pockets for successively supplying the tubes to a position at the free end of a respective mandrel means when the latter is moved to a predetermined position of said mandrel wheel means, rotatable guide disc means having a plurality of circular apertures positioned about the periphery thereof; first pusher rod means for successively pushing one end of each tube within one of the apertures at a first rotatable position of the star wheel means, to correctly configure the one end of each tube; and second pusher rod means for successively pushing each tube onto a respective mandrel means at a successive rotatable position of the star wheel means corresponding to the predetermined position of the respective mandrel means.

In accordance with another aspect of the present invention, a tube transfer assembly for a tube printer, includes rotatable mandrel wheel means for successively moving tubes to be printed to different stations of the tube printer; a plurality of mandrel means for holding the tubes on the mandrel wheel means; a plurality of sleeves slidably mounted on the plurality of mandrel means; backstop means engaged with the sleeves at a plurality of rotatable positions of the mandrel wheel means for preventing sliding movement of the sleeves on the respective mandrel means thereat and disengaged from the sleeves at one other rotatable position of the mandrel wheel means for permitting sliding movement of the sleeves on the respective mandrel means thereat; and tube discharge means for slidably moving the sleeve on the respective mandrel means at the one other rotatable position of the mandrel wheel means to remove the tube on the respective mandrel means thereat.

In accordance with still another aspect of the present invention, a tube transfer assembly for a tube printer includes rotatable mandrel wheel means for successively moving tubes to be printed to different stations of the tube printer; a plurality of mandrel means for holding the tubes on the mandrel wheel means, each mandrel means having a free end; rotatable star wheel means including a plurality of pockets for successively supplying the tubes to a position at the free end of a respective mandrel means when the latter is moved to a predetermined position of said mandrel wheel means; rotatable guide disc means having a plurality of circular apertures positioned about the periphery thereof; first pusher rod means for successively pushing one end of each tube within one of the apertures at a first rotatable position of the star wheel means, to correctly configure the one end of each tube; second pusher rod means for successively pushing each tube onto a respective mandrel means at a successive rotatable position of the star wheel means corresponding to the predetermined position of the respective mandrel means; a plurality of sleeves slidably mounted on the plurality of mandrel means; backstop means engaged with the sleeves at a plurality of rotatable positions of the mandrel wheel means for preventing sliding movement of the sleeves on the respective mandrel means thereat and disengaged from the sleeves at one other rotatable position of the mandrel wheel means for permitting sliding movement of the sleeves on the respective mandrel means thereat; and tube discharge means for slidably moving the sleeve on the respective mandrel means at the one other rotatable position of the mandrel wheel means to remove the tube on the respective mandrel means thereat.

The above, and other, objects, features and advantages of the present invention will become readily apparent from the following detailed description which is to be read in connection with the accomanying drawings.

DETAILED DESCRIPTION OF A PREFERRED EMBODIMENT

Figure 1:
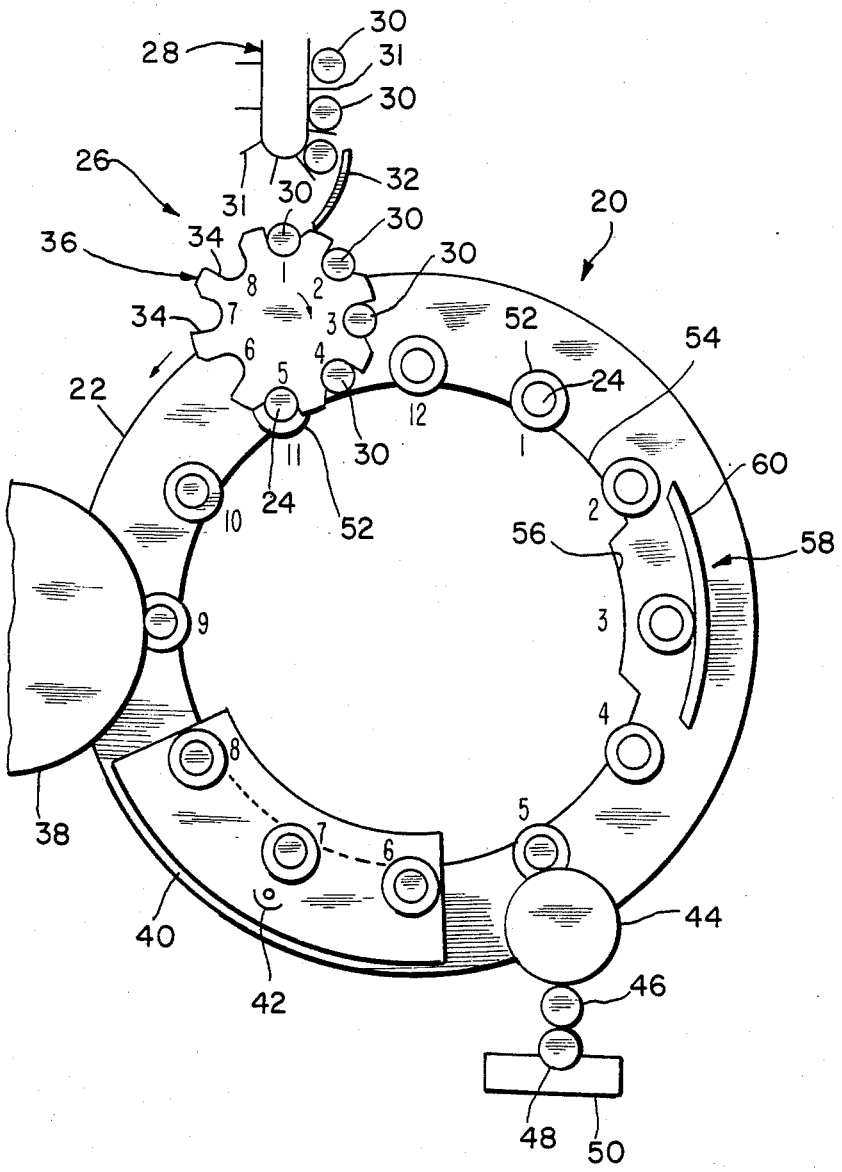
FIG. 1 is a schematic diagram of printing apparatus according to the present invention, used for illustrating the arrangement of the input transfer assembly and output transfer assembly.

Referring to the drawings in detail, and initially to FIG. 1 thereof, tube printing apparatus 20 according to the present invention generally includes a rotatable mandrel wheel 22 having a plurality of, for example, 12, regularly spaced mandrels 24 mounted along the circumferential periphery thereof. As shown in FIG. 1, the 12 mandrels 24 are equidistantly spaced along the circumferential periphery of rotatable mandrel wheel 22, and for ease of explanation, are shown at the hour positions 1–12 of a clock face.

Tube printing apparatus 20 includes an infeed transfer assembly 26 for transfering the tubes onto mandrels 24 at the eleven o'clock position, as shown in FIG. 1. Specifically, an infeed conveyor 28 conveys tubes 30 to infeed transfer assembly 26. Tubes 30, as previously discussed, are plastic, thin-walled, flexible tubes. Preferably, conveyor 28 includes a plurality of spaced dividers 31 which hold and separate tubes 30 on infeed conveyor 28. Tubes 30 fall by gravity at the lower portion of infeed conveyor 28 onto a guide 32 which guides each tube 30 into a respective pocket 34 of a rotatable star wheel assembly 36, which will be described in greater detail hereinafter. It will be noted that star wheel assembly 36 and mandrel wheel 22 are both intermittently rotated in synchronism with each other.

Thus, tubes 30 from conveyor 28 are deposited in a pocket 34 of star wheel assembly 36 at the number 1 position thereof. At the number 5 position of star wheel assembly 36, a pusher rod (not shown in FIG. 1) pushes a tube 30 onto the respective mandrel 24, which is then at the eleven o'clock position of mandrel wheel 22. In accordance with the present invention, prior to pushing a tube 30 onto the respective mandrel 24, and at position number 4, each tube 30 is biased by another pusher rod (not shown in FIG. 1) into a rotatable guide disc (also not shown in FIG. 1) to round out the end thereof so as to correctly configure the tube 30.

After a tube 30 is positioned on the respective mandrel 24 at the eleven o'clock position of mandrel wheel 22, the latter is intermittently rotated to the nine o'clock position of mandrel wheel 22 into surface contact with a rotating image-transfer mat or blanket designated schematically at 38, that forms part of the printing station of the apparatus 20. Thereafter, tubes 30, remaining on mandrels 24 are rotated away from the printing station to a drying or curing station 40, at which print is dried by ultraviolet light. Since the rotational movement is intermittent, the ultraviolet light is sufficient to dry the print. It will be noted that the drying operation occurs only at the seven o'clock position of mandrel wheel 22, as indicated schematically by the lamp 42 thereat. However, drying station 40 also covers the mandrels at the six and eight o'clock positions of mandrel wheel 22 to prevent extraneous UV light from escaping the drying station. Thereafter, tubes 30 are rotated away from drying station 40 and given a coating of varnish by means of peripheral surface engagement with a varnish applicator roll 44 at the five o'clock position of mandrel wheel 22, varnish applicator roll 44 forming part of the varnishing station of tube printing apparatus 20. Varnish applicator roll 44 is generally made of a rubber or like material and is rotated by suitable transmission means, not shown. Varnish is applied to varnish applicator roll 44 by steel rolls 46 and 48 which, in turn, are supplied with the varnish from a reservoir 50, as is well known in the art.

A sleeve 52 is slidably positioned on each mandrel 24, and is normally at the proximal end thereof behind the respective tube 30. A backstop 54 normally engages each sleeve 52 to prevent sliding movement thereof. Backstop 52 is cut-away at cut-away section 56 corresponding to the three o'clock position of mandrel wheel 22, and thereby does not engage the respective sleeve 52 thereat. In accordance with the present invention, a take-off or exit transfer assembly 58 includes a pusher take-off 60 at the three o'clock position of mandrel wheel 22 which engages the respective sleeve thereat. Thus, when a mandrel 24 is moved to the three o'clock position of mandrel wheel 22 during intermittent rotation thereof, pusher take-off 60 engages the respective sleeve 52 thereat and slides the same from the proximal toward the distal end of the respective mandrel 24 to discharge the tube 30 thereon onto, for example, a pin conveyor.

Figure 2:
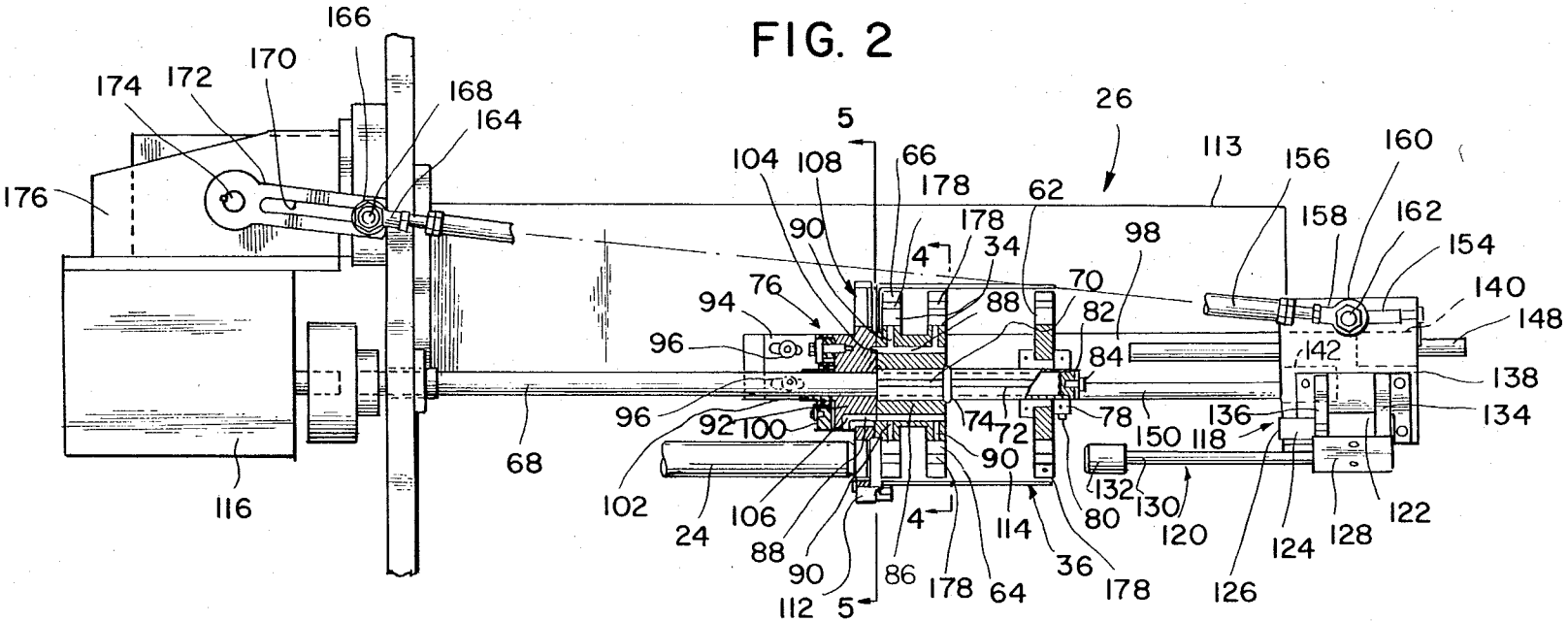
FIG. 2 is a side elevational view, partly in cross-section of the input transfer assembly of the present invention.
Figure 4:
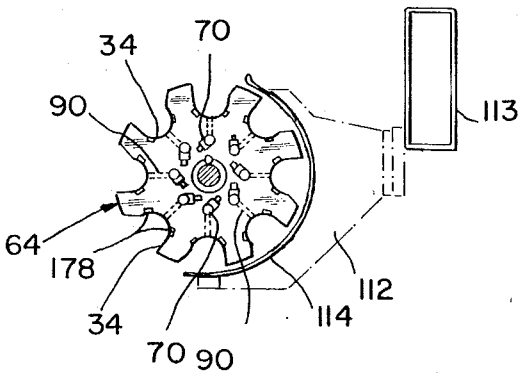
FIG. 4 is a cross-sectional view of a portion of the input transfer assembly of FIG. 2 taken along line 4—4 thereof.
Figure 3:
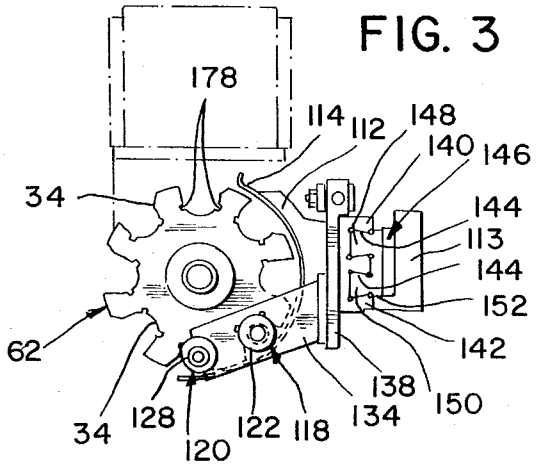
FIG. 3 is an end view of the input transfer assembly of FIG. 2, looking from the right-hand side thereof.

Referring now to FIGS. 2–5, a detailed description of infeed transfer assembly 26 will now be given. As shown in FIGS. 2–4 star wheel assembly 36 includes three star wheel discs 62, 64 and 66, each including a plurality of, for example, eight pockets 34. Star wheel discs 62, 64 and 66 are each keyed to a rotatable drive shaft 68 by means of key assemblies 70 and 72, as shown schematically, so as to be rotatable with drive shaft 68. Star wheel discs 64 and 66 are also slidably fixed on drive shaft 68 by means of a locking ring 74 at one side and a vacuum assembly 76 at the opposite side, both locking ring 74 and vacuum assembly 76 sandwiching star wheel discs 62 and 64 therebetween. On the other hand, star wheel disc 62 is slidably mounted on drive shaft 68. Specifically, star wheel disc 62 is fixed to a collar 78 which is keyed to drive shaft 68 by key assembly 72 and which includes locking means, such as a locking screw 80 for slidably locking collar 78 to drive shaft 68. In this manner, collar 78, and thereby star wheel disc 62, are slidable along drive shaft 68 and can be locked in place therealong, while also being keyed thereto so as to be rotatable therewith. In this manner, star wheel disc 62 can be slidably adjusted along drive shaft 68 to accommodate tubes 30 of different lengths. In addition, a spacer 82 is secured to the free or distal end of drive shaft 68 by a bolt 84 to prevent collar 78, and thereby star wheel 62, from sliding off of drive shaft 68.

As shown in FIGS. 2 and 4, star wheel discs 64 and 66 are connected together by a hub 86. Axial vacuum lines 88 associated with respective pockets 34 of star wheel discs 64 and 66 extend in an axial direction within hub 86. Secondary vacuum lines 90 interconnect pockets 34 of star wheel discs 64 or 66 with the respective vacuum line 88. Thus, application of a vacuum to vacuum lines 88 results in tubes 30 being pulled into pockets 34 of star wheel discs 64 and 66, through secondary vacuum lines 90, as star wheel assembly 36 rotates, thereby holding tubes 30 therein.

Vacuum assembly 76 includes a vacuum disc 92 rotatably mounted on drive shaft 68. In particular, a bracket 94 is secured by bolts 96 to a machine support 98. Bracket 94 is, in turn, secured to another bracket 100 which is rotatably mounted on shaft 68 by means of a bearing assembly 102. Bracket 100, in turn, is secured to an end face of vacuum disc 92 so as to rotatably mount the same about drive shaft 68.

The opposite end face of vacuum disc 92 is in abutting and sealing relation with the relative end face of hub 86. It is to be remembered, however, that vacuum disc 92 does not rotate with hub 86. The abutting end face of vacuum disc 92 includes a plurality of vacuum supply lines 104 shown more particularly in FIG. 5. Vacuum supply lines 104 are connected with an input vacuum supply line 106, and whereby a vacuum is supplied to secondary vacuum lines 90 at positions corresponding to those numbered 1–5 in FIG. 5. The number 1 position in FIG. 5 corresponds to the position at which tubes 30 are supplied to star wheel assembly 36 and the number 5 position corresponds to the position of star wheel assembly 36 at which tubes 30 are pushed onto mandrels 24. The remaining positions are not used to hold tubes 30, and accordingly, no vacuum is applied thereto.

Figure 5:
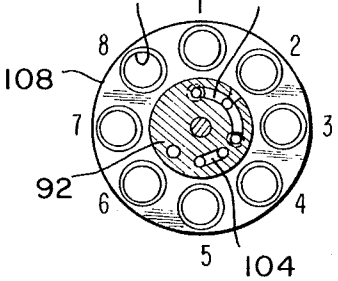
FIG. 5 is a cross-sectional view of a portion of the input transfer assembly of FIG. 2, taken along line 5—5 thereof.

In accordance with the present invention, a rotatable guide disc 108, shown in FIGS. 2 and 5, includes a plurality of through bores 110 around the circumferential periphery thereof in line with pockets 34 of star wheel assembly 36. Guide disc 108 is fixed to the end face of star wheel disc disc 66 and is rotatable therewith about vacuum disc 92. As shown, each bore 110 diverges from the side facing star wheel disc 66 to a point partially within the respective bore 110, the purpose of which will be made apparent from the discussion which follows.

In addition, a bracket 112 secured to the housing of the apparatus supports a guide 114 which surrounds star wheel assembly 36 between positions 2 and 5 to insure that tubes 30 do not fall out of pockets 34 in the event that the vacuum should fail.

Thus, with the apparatus so far described, drive shaft 68 is caused to index by an indexer 116 which, in turn, is driven by the main transmission of the apparatus (not shown), to intermittently rotate star wheel assembly 36 and rotatable guide disc 108 to successivly bring tubes 30 to a position in front of the respective mandrel 24 at the eleven o'clock position of mandrel wheel 22, as previously described.

In accordance with the present invention, as previously discussed with respect to FIG. 1, at the number 4 position of star wheel assembly 36, the thin-walled, cylindrical tubes 30 are pushed into a respective through bore 110 of rotatable guide disc 108 so as to correctly configure the respective end of each tube 30. The tubes 30, however, are not pushed onto a mandrel 24 at all, at this time. Since through bores 110 have a tapered configuration at the entrance end thereof, even if the ends of tubes 30 are out of round, the ends thereof will be forced into the tapered portions of through bores 110 and then into the main portions thereof so as to be correctly configured with an absolute circular configuration.

Intermittent movement of star wheel assembly 36 and rotatable guide disc 108 is synchronized with the intermittent movement of rotatable mandrel wheel 22. Thus, for each intermittent rotational movement of star wheel assembly 36, rotatable mandrel wheel 22 intermittently rotates one position. During the next intermittent rotational movement, the tube 30 which has been pushed into a through bore of rotatable guide disc 108 at position number 4 thereof is intermittently moved to position number 5 thereof, corresponding to the eleven o'clock position of mandrel wheel 22. At the same time, mandrel wheel 22 is intermittently rotated so that the mandrel at the twelve o'clock position is moved to the eleven o'clock position. The tube 30 which was previously pushed into a through bore 110 of rotatable guide disc 108 is then pushed onto mandrel 24 at the eleven o'clock position of mandrel wheel 22.

Specifically, infeed transfer assembly 26 includes a first pusher assembly 118 which pushes the tubes 30 into through bores 110 of rotatable guide disc 108 at the number 4 position thereof, and a second pusher assembly 120 which simultaneously pushes the tubes 30 onto mandrels 24 at the number 5 position of rotatable guide disc 108 and the eleven o'clock position of mandrel wheel 22.

First pusher assembly 118 includes a push rod housing 122 having a piston head 124 secured in axial alignment therewith and having an end face 126 which is generally larger than the diameter of tubes 30. Thus, during axial movement thereof, as will be discussed hereinafter, end face 126 abuts against an end of a tube 30 which extends slightly from the end surface of star wheel disc 62 so as to bias the same in the leftward direction of FIG. 2 so that the opposite end of the tube 30 is positioned within the through bore 110 of rotatable guide disc 108 then at the number 4 position thereof.

In like manner, second pusher assembly 120 includes a push rod housing 128 and a pusher rod 130 extending axially therefrom in the leftward direction of FIG. 2, as shown. A pusher head 132 is secured to the distal end of pusher rod 130. Push rod housings 122 and 128 are fixedly held in place with respect to the number 4 and number 5 positions of star wheel assembly 36 and rotatable guide disc 108 by means of parallel pusher mount brackets 134 and 136, which are secured in a cantilevered manner to a pusher mount plate 138. As will now be described, pusher mount plate 138 moves in the horizontal direction of FIG. 2 so as to simultaneously move pusher heads 124 and 132 in the leftward direction of FIG. 2, whereby a tube 30 at the number 4 position of star wheel assembly 36 is pushed into a through bore 110 of rotatable guide disc 108 by pusher head 124, and a tube 30 at the number 5 position of star wheel assembly 36 is pushed onto a mandrel 24 at the number 5 position of star wheel assembly 36 and at the eleven o'clock position of mandrel wheel 22.

Specifically and referring to FIGS. 2 and 3, an upper slide assembly 140 and a lower slide assembly 142 are secured to the opposite surface of pusher mount plate 138 in staggered relation to each other, that is, offset in the horizontal direction from each other, as shown in dashed lines in FIG. 2. Each slide assembly is cut away to define a track 144 extending in the horizontal direction of FIG. 2 and shown more particularly in FIG. 3. Track 144 has an irregular configuration so as to provide a keying effect, as will be made clear from the description hereinafter. A slider 146, shown in FIG. 3, is secured to another section of housing 113 and includes an upper slider element 148 and a lower slider element 150 which are of the same irregular configuration as tracks 144 and which slide within tracks 144 of upper slide assembly 140 and lower slide assembly 142, respectively. In effect, upper and lower slide elements 148 and 150 are thereby keyed within upper and lower slide assemblies 140 and 142, respectively, but are permitted to slide in a horizontal direction thereof. To aid in the sliding movement, ball bearings 152 or like assemblies are provided between upper slider element 148 and track 144 of upper slide assembly 140 and between lower slider element 150 and track 144 of lower slide assembly 142.

Referring back to FIG. 2, pusher mount plate 138 is provided with an elongated slot 154 extending in the horizontal direction of FIG. 2 at the upper end thereof. A connecting rod 156 has one end thereof secured within slot 154. Specifically, one end of connecting rod 156 is provided with a stud 158 having an enlarged end 160 with a hole (not shown) therein through which locking means 162 such as a bolt, washer and nut extend for releasably locking such end of connecting rod 156 to pusher mount plate 138 at a desired position within slot 154. The opposite end of connecting rod 156 is provided with a stud 164 having an enlarged end 166 and locking means 168 for releasably locking such end within an elongated slot 170 of a lever 172 which is rotatably mounted at its opposite end to a shaft 174, which in turn, is driven through a gear box 176 in synchronism with rotation of drive shaft 68 by motor 116. In effect, lever 172 is rotatably driven by motor 116 through gear box 176 and shaft 174. It will be appreciated that, although studs 158 and 164 are locked at the desired positions within slots 154 and 170, they are allowed to pivot by reason of the locking means 162 and 168, as is necessary during rotation of lever 172.

Thus, in operation, after each intermittent rotation of drive shaft 68, lever 172 is caused to rotate such that pusher heads 118 and 132 push tubes 30 at position numbers 4 and 5 of star wheel assembly 36 and rotatable guide disc 108, as aforementioned. Thus, with this arrangement, the tubes are first correctly configured to provide a rounded end thereof and then are pushed onto the respective mandrel 24 so that no damage occurs to the tubes during pushing of the same onto the mandrels 24.

During the second pushing operation at the eleven o'clock position of mandrel wheel 22, pusher head 132, unlike pusher head 124, slides within the respective pockets 34 within star wheel discs 62, 64 and 66 and the respective through hole 110 of rotatable guide disc 108. Since the tubes are of a similar outside diameter, pusher head 132 may slide within a portion of the end of the respective tube 30 and damage the same, by bending or crimping the end. In order to avoid this, each pocket 134 is formed with two spaced notches 178.

Figure 6:
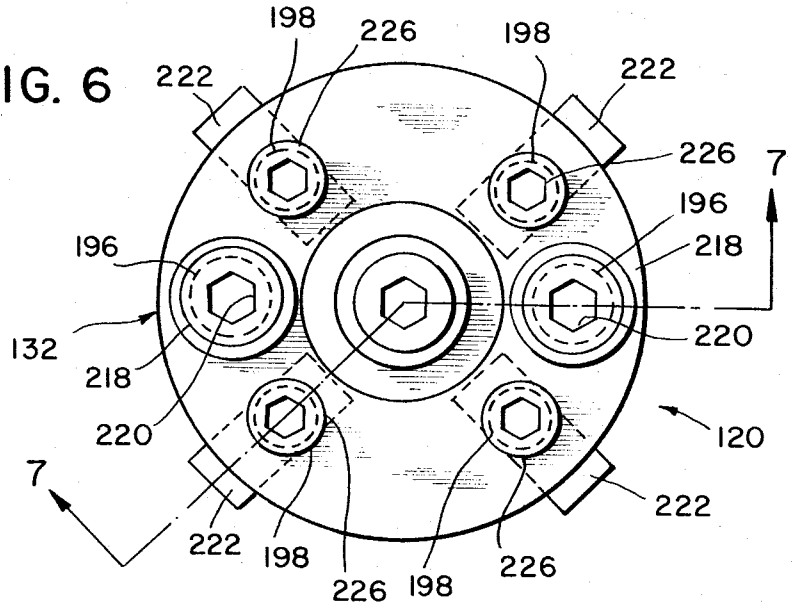
FIG. 6 is an end plan view of the second pusher rod of the input transfer assembly of FIG. 2.
Figure 7:
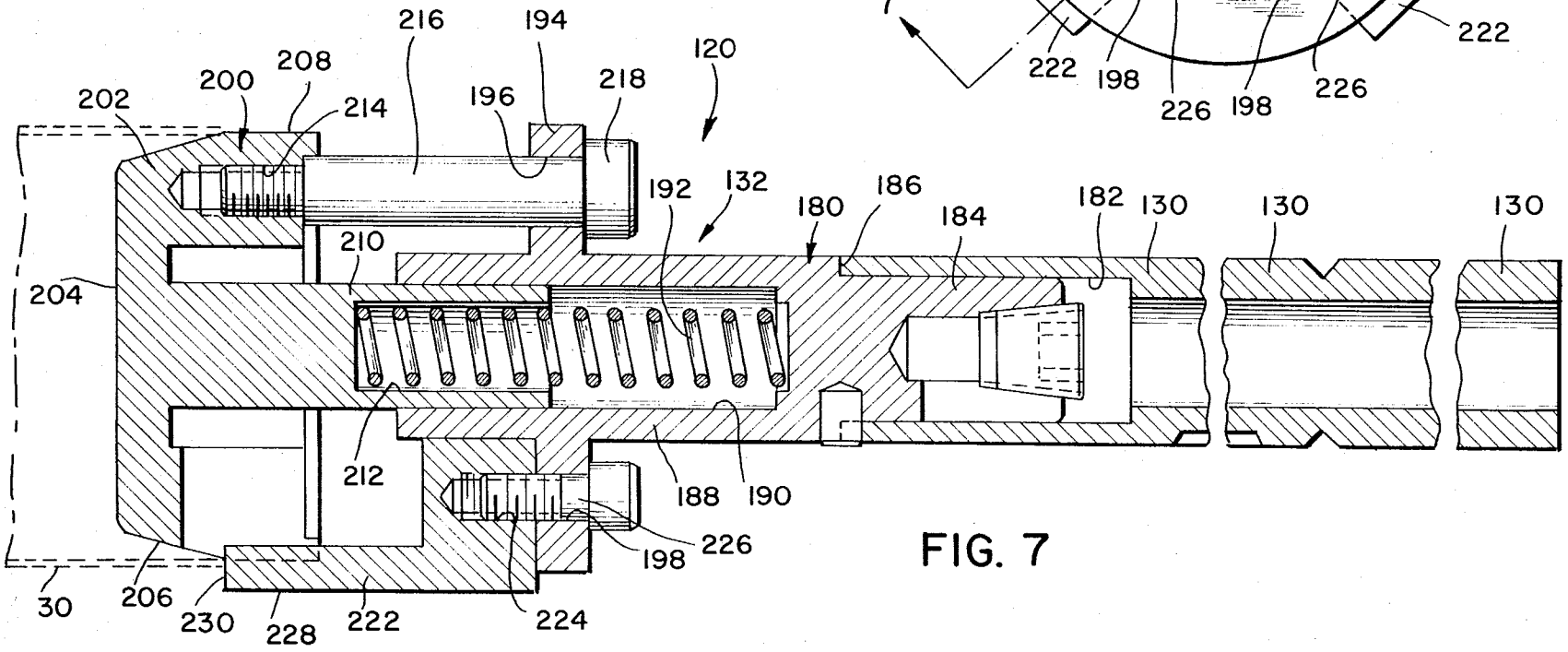
FIG. 7 is a cross-sectional view of the second pusher rod of FIG. 6 taken along line 7—7 thereof.

Referring now to FIGS. 6 and 7, second pusher assembly 120 will now be described in greater detail, by which the reason for notches 178 will become readily apparent. As shown, pusher head 132 includes a spring retainer 180 fixedly secured to the free end of pusher rod 130. Specifically, the free end of pusher rod 130 has an annular opening 182 through which the proximal end 184 of spring retainer 180 is positioned, spring retainer 180 being provided with a circumferential shoulder 186 which abuts against the circumferential end of pusher rod 130 to limit the extent of travel of proximal end 184 within annular opening 182. It will be noted that the outside diameter of spring retainer 180 is identical to that of pusher rod 130, so that there is a continuity. The distal end 188 of spring retainer 180 is provided with an annular spring retainer opening 190 within which a coil spring 192 is positioned. Spring retainer 180 is also formed with a circumferential flange 194 on the outer surface of distal end 188 thereof. As shown in FIGS. 6 and 7, circumferential flange 194 is provided with two diametrically opposed larger diameter bores 196 and four equidistantly spaced smaller diameter bores 198. The outer diameter of circumferential flange 194 is slightly smaller than the diameter of pockets 34.

A tube engaging head 200 is formed with an enlarged head 202 having a circular, forward end face 204 which tapers outwardly, as at 206 and then forms a constant diameter inner portion 208 having an outside diameter slightly smaller than the diameter of pockets 34. Tube engaging head 200 includes a central guide 210 extending rearwardly from enlarged head 202 and having an outside diameter similar to the inside diameter of annular spring retainer opening 190 and positioned therein. Central guide 210 includes its own annular spring retainer opening 212 at the proximal end thereof within which the opposite end of coil spring 192 is positioned. With this arrangement thus far discussed, it will be appreciated that coil spring 192 thereby normally biases enlarged head 202 outwardly, that is, away from spring retainer 180.

Enlarged head 202 is provided with two equidistantly spaced screw threaded bores 214. A bolt 216 having an enlarged head 218 with a hex nut recess 220 therein slidably extends through each larger diameter bore 196, with the end thereof being screw-threadedly secured within a respective bore 214. In this manner, tube engaging head 200 is slidably secured to spring retainer 180 and is normally biased by coil spring 192 to the position shown in FIG. 7. It will be appreciated, however, that the application of an external force to forward end face 204 will result in tube engaging head 200 moving to the right in FIG. 7 against the force of coil spring 192.

In addition, four fingers 222 are secured on the outer surface of spring retainer 180 at distal end 188 thereof, forward of circumferential flange 194. As shown, each finger 222 is formed in a L-shaped configuration with one leg thereof having a screw threaded bore 224 which screw-threadedly receives a bolt 226 extending through the respective smaller diameter bore 198, by which each finger 222 is fixed to spring retainer 180. The outer radial surface 228 of each finger 222 extends a distance greater than the diameter of pockets 34. This is the reason for providing pockets 34 with notches 178. Thus, as pusher head 132 travels through pockets 34, fingers 222 travel through notches 178 so that forward progress of second pusher assembly 120 is not impeded. It is noted that the end face 230 of each finger 222 has a dimension so as to abut against the end face of a respective tube 30 without travelling over or through the tube.

In operation, as second pusher assembly 120 is actuated, enlarged head 202 travels within the interior of the respective tube 30. Because of tapered portion 206, there may be no contact by enlarged head 202 with tube 30. If there is contact, it will be appreciated that a slight reverse force is applied against coil spring 192 to bias enlarged head 202 to the right of FIG. 7 so as not to damage the tube 30. Then upon continued movement of second pusher assembly 120, end faces 230 of fingers 222 engage the edge of the respective tube 30 and push the same forward onto mandrel 24.

Figure 8:
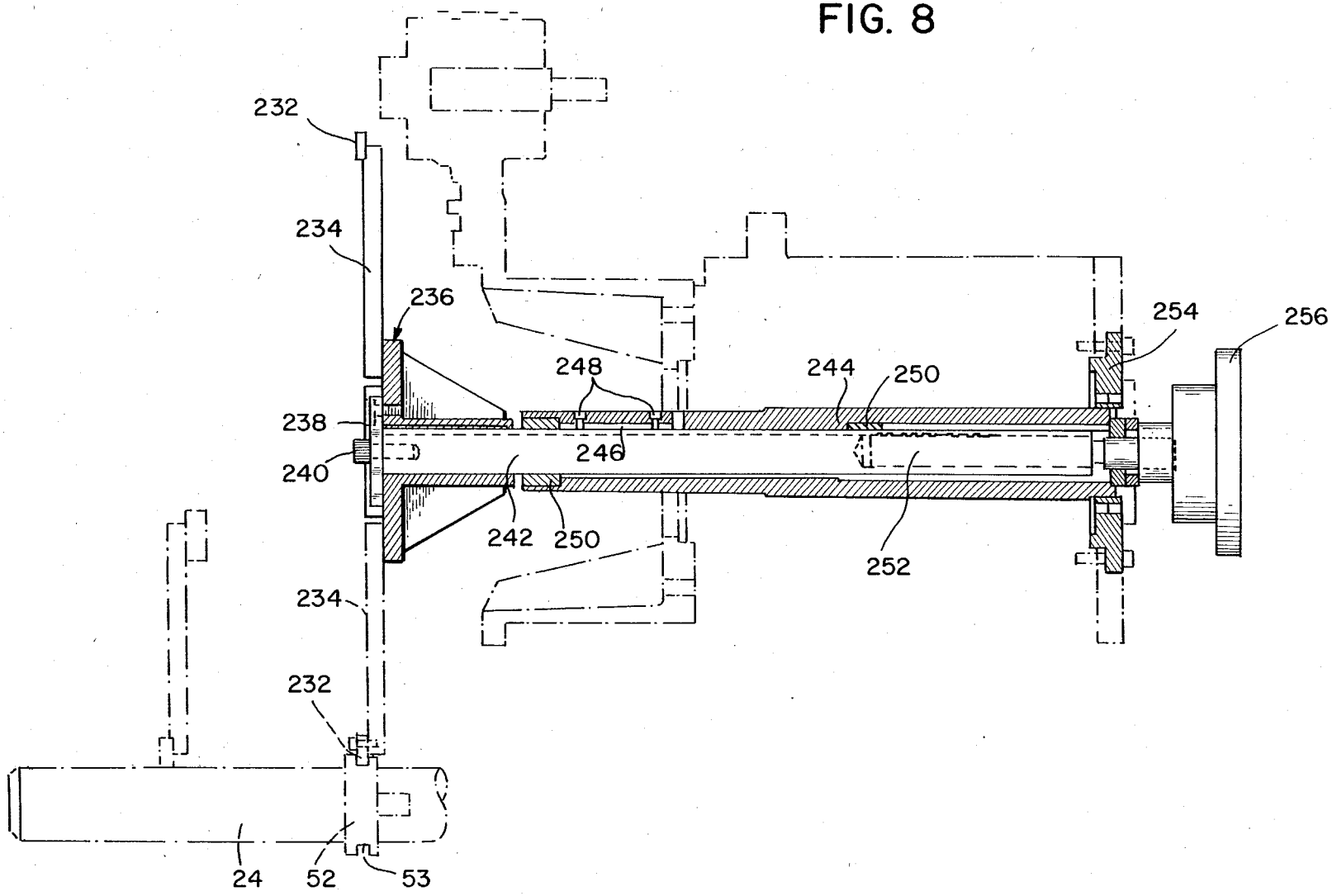
FIG. 8 is a side elevational view, partly in cross-section, of a portion of the exit transfer assembly according to the present invention.
Figure 9:
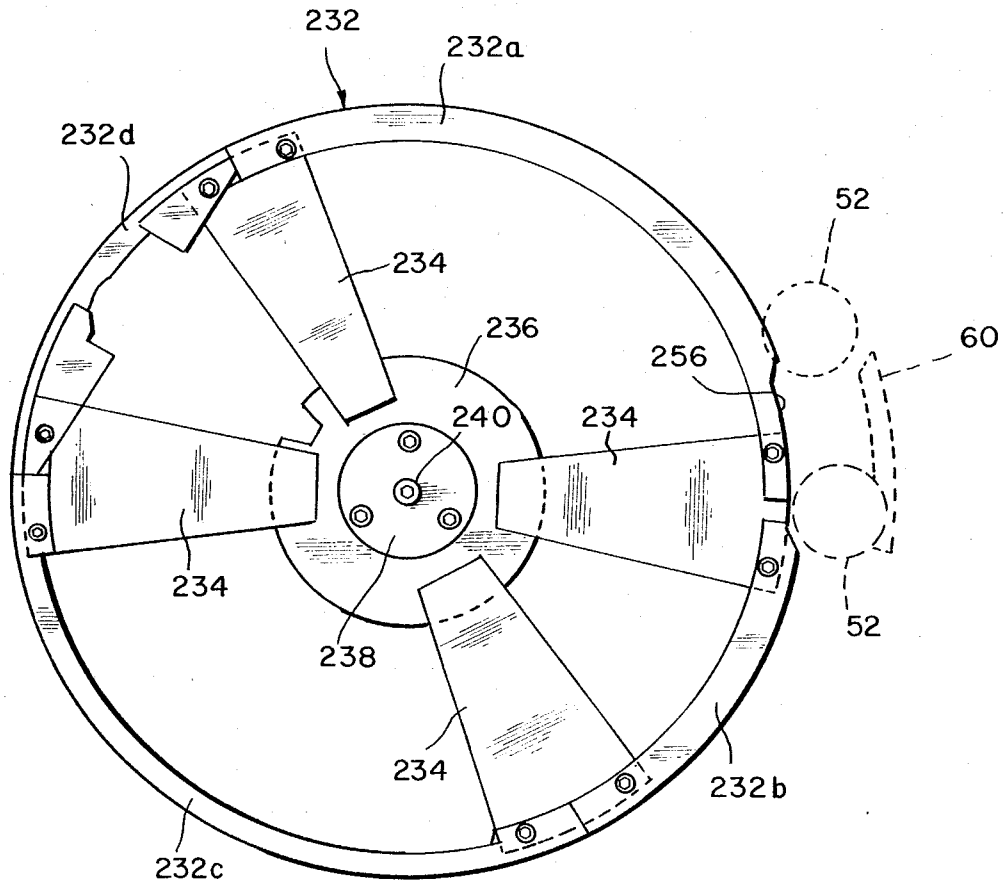
FIG. 9 is a plan view of a portion of the exit transfer assembly of FIG. 8.

Referring now to FIGS. 1, 8 and 9 a portion of take-off or exit transfer assembly 58 will now be described. As shown, each sleeve 52 includes a circumferential groove 53. Back stop 54 is formed by a circular track 232 which engages within circumferential groove 53 of each sleeve 52, except at the 3:00 position of mandrel wheel 22, as shown in FIG. 1. In actuality, circular track 232 may be formed in track sections **232*a*–232*d* which are secured to the outer periphery of radial track support vanes 234 which, in turn, are secured to a central hub 236 by any suitable means, as shown in FIG. 9. Central hub 236 is secured by a clamp cap 238 and a bolt 240 to a support shaft 242 which, in turn, is slideably received within a sleeve support 244. Support shaft 242 is keyed to sleeve support 244 by a key assembly 246 and can be locked in the axial direction thereof to sleeve support 244 by means of bolts 248. Thus, support shaft 242 can be slidably adjusted in the axial direction thereof with respect to sleeve support 244, and in this regard bushings 250** are provided.

Support shaft 242 is screw-threadedly received on an adjustment shaft 252 which, in turn, is rotatably journaled within a housing support 254 and is rotatable by means of a hand wheel 256. In this manner, rotation of hand wheel 256 results in support shaft 242 being moved axially such that circular track 232 also moves in such axial direction. For example, circular track 232 can therefore be moved to the position shown by dashed lines in FIG. 8 to accomodate different lengths of tubes to be printed.

As shown in FIG. 9, circular track 232 has a cut away section 256 of a lesser outer diameter than the remainder of circular track 232, at the 3:00 position of mandrel wheel 22, as previously discussed. Thus, during all of the positions of mandrel wheel 22, except the 3:00 position, circular track 232 engages sleeves 52 to prevent sliding movement thereof along the respective mandrels 24. At the 3:00 position of mandrel wheel 22, however, sleeves 52 are free to slide upon mandrel wheel 22. However, at this position, as previously discussed, pusher take-off 60 engages sleeves 52, as will now be described in greater detail with respect to FIGS. 10–13.

Figures 10, 11, 12, 13:
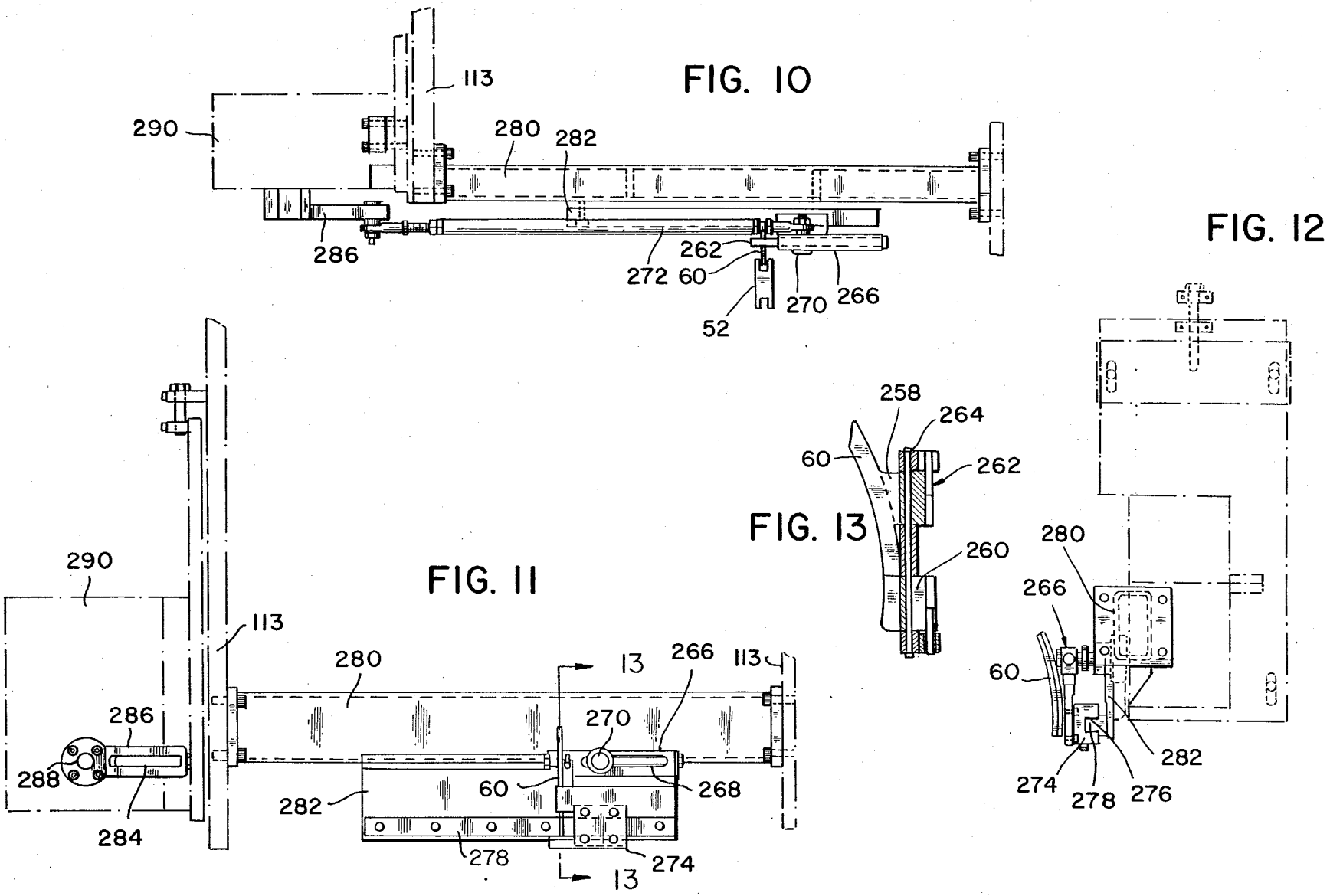
FIG. 10 is a top plan view of the tube discharge mechanism as part of the exit transfer assembly according to the present invention.
FIG. 11 is a side elevational view of the tube discharge mechanism of FIG. 10.
FIG. 12 is an end elevational view of the tube discharge mechanism of FIG. 10.
FIG. 13 is a partial cross-sectional view of a portion of the tube discharge mechanism of FIG. 11, taken along line 13—13 thereof.

As shown in FIGS. 10–13, pusher take-off 60 is formed with a curved configuration which follows the curvature of circular track 232 so as to engage sleeves 52 during rotation of mandrel wheel 22. Referring first to FIG. 13, pusher take-off 60 includes two spaced supports 258 and 260 which extend rearwardly thereof and are coupled to a support assembly 262 by means of a pin 264. Support assembly 262 is, in turn, secured to a slide plate take-off 266 having an elongated slot 268 therein through which a bolt 270 extends which slidably secures one end of a puller rod 272 therein.

A guide block 274 having a track 276 with a similar configuration to tracks 144 of FIG. 2, is secured to the rear surface of slide plate take-off 266 at the lower end thereof, as shown in FIG. 12. A slide 278 is secured to a track support post 280 through an intermediary support 282. Track support post 280 is supported to a portion of housing 113.

With the arrangement thus far discussed, it will be appreciated that, upon movement of puller rod 272, pusher take-off 60 is guided in the horizontal direction of FIG. 10 through slide plate take-off 266, guide block 274, and slide 278, the pushing or biasing force being applied by puller rod 272. In this regard, the opposite end of puller rod 272 is pivotally connected within an elongated slot 284 of a lever 286 which is rotatably indexed (intermittently rotated) by an indexer 290 which, in turn, is driven by the main transmission of the apparatus (not shown). In other words, rotation of lever 286 and thereby, movement of pusher take-off 60, is in synchronism with the aforementioned intermittent motions of the apparatus, such as rotation of mandrel wheel 22, rotation of star wheel assembly 36 and operation of first pusher assembly 118 and second pusher assembly 120.

In operation, when mandrel wheel 22 rotates to the 3:00 position thereof such that the sleeve 52 on the respective mandrel 24 is engaged by pusher take-off 60, the latter moves in a direction to slide sleeve 52 off the respective mandrel 24 and thereby strip the respective tube 30 off of mandrel 24 onto a pin chain positioned in front of such mandrel. During the next intermittent rotation of mandrel wheel 22, a return movement of pusher take-off 60, and thereby the respective sleeve 52, occurs so that, upon continued rotation of mandrel wheel 22, the respective sleeve 52 is again engaged by circular track 232 at the 2:00 position of mandrel wheel 22.

Having described a specific preferred embodiment of the invention with reference to the accompanying drawings, it is to be understood that the present invention is not limited to that precise embodiment, and that various changes and modifications may be effected therein by one of ordinary skill in the art without departing from the scope or spirit of the invention as defined by the appended claims.

What is claimed is:

1. A tube transfer assembly for a tube printer, comprising:

rotatable mandrel wheel means for successively moving tubes to be printed to different stations of said tube printer;

a plurality of mandrel means for holding said tubes on said mandrel wheel means, each said mandrel means having a free end;

rotatable star wheel means including a plurality of pockets for successively supplying said tubes to a position at the free end of a respective mandrel means when the latter is moved to a predetermined position by said mandrel wheel means;

rotatable guide disc means having a plurality of circular apertures positioned about the periphery thereof;

first pusher rod means for successively pushing one end of each tube within one of said apertures at a first rotatable position of said star wheel means, to correctly configure said one end of each tube; and second pusher rod means for successively pushing each tube onto a respective mandrel means at a successive position of said star wheel means corresponding to said predetermined position of the respective mandrel means.

2. A tube transfer assembly according to claim 1; including pusher rod drive means for simultaneously actuating said first pusher rod means to push one end of a tube within one of the apertures of said rotatable guide disc means and said second pusher means to push one end of another tube onto said mandrel means.

3. A tube transfer assembly according to claim 2; wherein said pusher rod drive means includes securing means for holding said first pusher rod means and second pusher rod means at fixed positions with respect to each other; guide means including at least one guide track for guiding movement of said securing means therealong, and pusher rod control means for simultaneously moving said first and second pusher rod means along said guide track such that said first pusher rod means pushes one end of a tube within one of said apertures of said rotatable guide disc means and said second pusher rod means simultaneously pushes one end of another tube onto said mandrel means at a successive rotatable position of said star wheel means.

4. A tube transfer assembly according to claim 3; wherein said pusher rod control means includes connecting rod means having a first end and a second end secured to said securing means, and drive assembly means secured to the first end of said connecting rod means for controlling said connecting rod means to move said securing means along said guide track in synchronism with rotation of said mandrel wheel means.

5. A tube transfer assembly according to claim 4; further comprising star wheel drive means for intermittently rotating said rotatable star wheel means and said rotatable guide disc means in synchronism with reciprocable movement of said first and second pusher rod means and with rotation of said rotatable mandrel wheel means.

6. A tube transfer assembly according to claim 1; further comprising star wheel drive means for intermittently rotating said rotatable star wheel means and said rotatable guide disc means in synchronism with reciprocable movement of said first and second pusher rod means and with rotation of said rotatable mandrel wheel means.

7. A tube transfer assembly according to claim 1; wherein said rotatable star wheel means includes vacuum line means for supplying a vacuum to said pockets thereof; and further comprising vacuum supply means for supplying a vacuum to said vacuum line means.

8. A tube transfer assembly according to claim 1; wherein each pocket is formed with at least one notch; and said second pusher rod means includes at least one finger for engaging and pushing said tubes onto said mandrel means, at least one of said fingers engaging within at least one of said notches during reciprocable movement of said second pusher rod means.

9. A tube transfer assembly according to claim 1; wherein said second pusher rod means includes a pusher rod having a distal end, a pusher head slidably secured to said pusher rod at the distal end thereof and spring means positioned between said pusher rod and said pusher head for normally biasing said pusher rod and said pusher head apart.

10. A tube transfer assembly for a tube printer, comprising:

rotatable mandrel wheel means for successively moving tubes to be printed to different stations of said tube printer;

a plurality of mandrel means for holding said tubes on said mandrel wheel means, each said mandrel means having a free end;

rotatable star wheel means including a plurality of pockets for successively supplying said tubes to a position at the free end of a respective mandrel means when the latter is moved to a predetermined position of said mandrel wheel means;

rotatable guide disc means having a plurality of circular apertures positioned about the periphery thereof;

first pusher rod means for successively pushing one end of each tube within one of said apertures at a first rotatable position of said star wheel means, to correctly configure said one end of each tube;

second pusher rod means for successively pushing each tube onto a respective mandrel means at a successive rotatable position of said star wheel means corresponding to said predetermined position of the respective mandrel means;

a plurality of sleeves slidably mounted on said plurality of mandrel means backstop means engaged with said sleeves at a plurality of rotatable positions of said mandrel wheel means for preventing sliding movement of said sleeves on the respective mandrel means thereat and disengaged from said sleeves at one other rotatable position of said mandrel wheel means for permitting sliding movement of said sleeves on the respective mandrel means thereat; and tube discharge means for slidably moving the sleeve on the respective mandrel means at said one other rotatable position of said mandrel wheel means to remove the tube on said respective mandrel means thereat.

11. A tube transfer assembly according to claim 10; including pusher rod drive means for simultaneously actuating said first pusher rod means to push one end of a tube within one of the apertures of said rotatable guide disc means and said second pusher means to push one end of another tube onto said mandrel means.

12. A tube transfer assembly according to claim 11; wherein said pusher rod drive means includes securing means for holding said first pusher rod means and said second pusher rod means at fixed positions with respect to each other; guide means including at least one guide track for guiding movement of said securing means therealong, and pusher rod control means for simultaneously moving said first and second pusher rod means along said guide track such that said first pusher rod means pushes one end of a tube within one of said apertures of said rotatable guide disc means and said second pusher rod means simultaneously pushes one end of another tube onto said mandrel means at a successive rotatable position of said star wheel means.

13. A tube transfer assembly according to claim 12; wherein said pusher rod control means includes connecting rod means having a first end and a second end secured to said securing means, and drive assembly means secured to the first end of said connecting rod means for controlling said connecting rod means to move said securing means along said guide track in synchronism with rotation of said mandrel wheel means.

14. A tube transfer assembly according to claim 10; further comprising star wheel drive means for intermittently rotating said rotatable star wheel means and said rotatable guide disc means in synchronism with reciprocable movement of said first and second pusher rod means and with rotation of said rotatable mandrel wheel means.

15. A tube transfer assembly according to claim 10, wherein each pocket is formed with at least one notch; and said second pusher rod means includes at least one finger for engaging and pushing said tubes onto said mandrel means, at least one of said fingers engaging within at least one of said notches during reciprocable movement of said second pusher rod means.

16. A tube transfer assembly according to claim 10; wherein said backstop means includes circular track means having a first outside diameter along a major portion thereof for engaging said sleeves to prevent sliding movement thereof on the respective mandrel means at said plurality of rotatable positions of said mandrel wheel means, and having a second lesser diameter which does not engage said sleeves at a position corresponding to said one other rotatable position of said mandrel wheel means to permit sliding movement of said sleeves on the respective mandrel means thereat.

17. A tube transfer assembly according to claim 10; wherein said tube discharge means includes pusher take-off means for engaging said tubes at said one other rotatable position of said mandrel means, guide means for guiding sliding movement of said pusher take-off means between a position at which a tube is on the respective mandrel means and a position which strips the tube from said mandrel means, and control means for controlling reciprocable movement of said pusher take-off means along said guide means to strip said tube off the respective mandrel means at said one other rotatable position of said mandrel wheel means.

18. A tube transfer assembly according to claim 17; wherein said control means includes connecting rod means having a first end and a second end secured to said pusher take-off means, and drive assembly means secured to said first end of said connecting rod means for driving said pusher take-off means in a reciprocable motion along said guide means in synchronism with rotational movement of said mandrel wheel means.

* * * * *